United States Patent [19]

Deschler et al.

[11] 3,981,281

[45] Sept. 21, 1976

[54] CAM FOR CONTROLLING VALVES OF AN INTERNAL COMBUSTION ENGINE

[75] Inventors: Gerhard Deschler; Dieter Wittmann; Reinhold Trier, all of Nurnberg, Germany

[73] Assignee: Maschinenfabrik Augsburg-Nurnberg AG, Nurnberg, Germany

[22] Filed: June 20, 1975

[21] Appl. No.: 588,968

[30] Foreign Application Priority Data

June 20, 1974 Germany ..... 2429708

[52] U.S. Cl. ..... 123/90.6; 74/567

[51] Int. Cl.[2] ..... F16H 53/00

[58] Field of Search ..... 123/90.6; 74/567

[56] References Cited

UNITED STATES PATENTS 2,628,605 2/1953 Jones ..... 123/90.6

*Primary Examiner*—Charles J. Myhre
*Assistant Examiner*—Daniel J. O'Connor
*Attorney, Agent, or Firm*—Walter Becker

[57] ABSTRACT

A cam for controlling the valve of an internal combustion engine which controls the valve by means of a valve tappet having a flat bottom, against the thrust of a closing spring. The acceleration and the deceleration regions are divided into a total of five sections I-V of which the acceleration sections I and V are defined by a Fourier series of the third order represented by the equation:

$$z_j = a_{j1}\sin\alpha + a_{j2}\sin 2\alpha + a_{j3}\sin 3\alpha$$

in which $j$ represents one of the respective sections I and V, while $a_{j1}$ to $a_{j3}$ are selected in conformity with the required conditions, and while $\alpha$ represents a function of the cam angle $x$. The section II which follows the opening flank and the section IV preceding the closing flank result in a precisely constant ascent of the lubrication number curve while in connection with the cam stroke to section II the following equation applies:

$$z_{II} = a\sin[\sqrt{0.5}(x-WP\ddot{O})]-SK(x-WP\ddot{O})+z_{A\,II}$$

and while section IV is represented by the equation:

$$z_{IV}=a_7\sin[\sqrt{0.5}(x-SKS)]+a_8\cos[\sqrt{0.5}(x-SKS)]+SK(x-SKS)+z_{A\,IV}$$

The values $a$ and $z_A$ are obtained from the continuity of the left curve (z) and its first and second derivation $z'$, $z''$ according to the cam angle $x$. $WP\ddot{O}$ represents the point of reversal with the cam lift at the opening side, whereas $SK$ represents value of ascent, and $SKS$ represents the start of the constant drop of the lubrication number at the closing side. In the section III, within the region of the maximum retardation a constant lubrication number is obtained which is determined by its relationship to the cam stroke or cam lift and expressed by:

$$z_{III} = a_5\sin[\sqrt{0.5}(x-SK\ddot{O})]+a_6\cos[\sqrt{0.5}(x-SK\ddot{O})]+Smax+RG$$

In this equation $SK\ddot{O}$ represents the end of the constant ascent of the cam, while $S$max represents the lubrication value, and $RG$ represents the radius of the base circle of the cam.

1 Claim, 2 Drawing Figures

CAM FOR CONTROLLING VALVES OF AN INTERNAL COMBUSTION ENGINE

The present invention relates to a cam for controlling valves of an internal combustion engine, which cam opens the valves by means of a tappet rod having a flat bottom. This opening takes place against the thrust of a closing spring, the acceleration as well as retardation range being divided into a number of phases without the necessity for symmetry.

Internal combustion engines with cyclic operation require valves to control the combustion. These valves are opened by cams arranged on a shaft, at predetermined times, the so-called "control times". The high accelerations brought about at the conversion of the rotary movement of the cam into a reciprocatory movement at the valve will in the control elements cause considerable loads which particularly in the cams and push rods due to the friction therebetween can bring about a considerable wear. In addition, under some circumstances, tears and breaks occur with the valves which may do such damage as to bring about a total failure of the engine. In addition thereto, under some circumstances also breaks in the valve occur which lead to such damage that a total failure of the engine occurs. The reasons responsible for this situation reside on one hand in the defective formation of a hydrodynamic lubricating film between the cam and the push rod and on the other hand in the too high oscillation amplitudes of the moved valve masses or in the interruption of the power flow between the cam and the push rod. It has now been found that the jerk-free acceleration and retardation course of the cam must be so designed that the dynamic as well as the hydrodynamic influences will be taken into consideration when designing the cam profile, without the necessity of a symmetry of the cam which means without a mirror image acceleration course in the cam opening and closing flank and the cam tip.

With regard to controlling the dynamic behavior, various jerk-free cams have become known the calculation of which, however, is based on a symmetrical cam profile which means symmetry in the lifting curve ($z$ in FIG. 1) and in their derivations with regard to the cam angle ($x$ in FIG. 1) while different objects are to be realized.

The polydyne cam developed by Dudley, Thoren, Engemann and Stoddart determines with a continuous polynomial statement, while considering the valve control elasticity, a symmetrical stroke curve with the object in mind for a certain speed to obtain an oscillation-free valve operation. Expediently, the profile for the maximum speed is designed vibration or oscillation-free while at the lower speeds, for physical reasons, higher vibration or oscillation amplitudes may occur. In the thesis by Schrick "The Dynamic Behavior of Valve Controls in Internal Combustion Engines", it has been proved by examining polydyne cams that while a vibration-free operation is assured for the speed selected for the design, at the remaining speeds, the polydyne cams may under circumstances be inferior to other acceleration courses with regard to the dynamic behavior. The problem of the designing vibration-free cam profiles is now to be discussed in order over an entire speed range to obtain an optimum solution of the dynamic behavior. This is a problem that can be only incompletely solved by a mathematical function alone without digital or analogous simulation of the valve operation.

Bensinger and Kurz suggest a calculation method for a jerk-free symmetric cam the retardation section of which from the reversal point WPÖ (FIG. 1) to the maximum cam lift Zmax (FIG. 1) is characterized in that between the spring force and the mass force curve without taking into consideration vibration influences, there exists near parallelity whereby a raising of the limit speed relative to the jerk cam is possible.

With this suggested cam, only an approximate parallelity exists because the spring force characteristic is not taken into consideration during the calculation. Only by the publication by Gundermann "Calculation of a Valve Control Cam for an Internal Combustion Engine" in the publication "Construction", ("Konstruktion") issue 2/1969, German Pat. No. 1,526,488, a cam profile has become known with which in the critical retardation range, statically considered, the mass force curve is precisely parallel to the spring force curve. The adjacent retardation range in the vicinity of the maximum cam stroke is characterized by constant contact pressure. It is known that in the vicinity of the maximum cam stroke the maximum contact pressures occur between cam and push rod at low motor speed or at the idling of the motor in view of the lack of mass inertia forces.

With regard to the cam profiles suggested by Bensinger and Kurz and Gundermann it has to be mentioned that extensive parallelity or genuine parallelity between the spring and mass forces and constant contact pressure at the cam tip cannot occur with a system having inherent thereto mass and elasticity. To such systems belongs the valve control. Measurements on the test stand have proved that oscillation amplitudes are superimposed upon the spring force excess (difference between mass force and spring force) which is necessary for maintaining the friction between the cam and the push rod, and that these oscillation amplitudes in the most unfavorable instance may even nullify said friction. Similarly, the laying down of a constant maximum contact pressure has only theoretical value in view of the oscillation or vibration influences.

In all of the above described calculation methods, with different means always only the dynamic behavior is affected or influenced. Inasmuch as during the course of movement of the cam and of the push rod a friction transmission is involved where relative movements occur, also the hydrodynamic behavior has to be taken into consideration. In the cams of the prior art, this hydrodynamic behavior has not been taken into consideration.

In the publication "The Influence of the Lubricating Conditions on the Cam Drive" ("Der Einfluss der Schmierverhallnisse am Nockentrieb") by Dr. Ing. R. Muller in the MTZ issue 27/2, the lubrication number $s$ is defined as characteristic number for the design of a hydrodynamic lubricating film between the cam and the push rod of the valve. This characteristic number is dependent solely on the cam geometry, in other words does not change under the influence of the dynamics. The lubrication number $$s = -(z'' + RN)$$

is formed from the respective cam radius $RN$ and the cam acceleration $z''$, in other words from the pertaining second derivation $z'' = d^2 z/dx^2$ of the stroke $z$ according to the cam angle $x$. The higher the absolute value of the lubrication number $s$ is, the higher will be the probability of a good lubricating film formation. For this reason, the critical phase with regard to the lubrication is the retardation or deceleration range when the cam acceleration $z''$ and the cam radius RN have different prefixes and, therefore, low positive values result for s at the cam nose and the lubrication number function in the transition region between nose and flanks change the prefix (see FIG. 2).

It is an object of the present invention so to design a cam of the above mentioned type that the wear thereof will be reduced to a minimum.

This object and other objects and advantages of the invention will appear more clearly from the following specification in connection with the accompanying drawings, in which.

Figure 1:
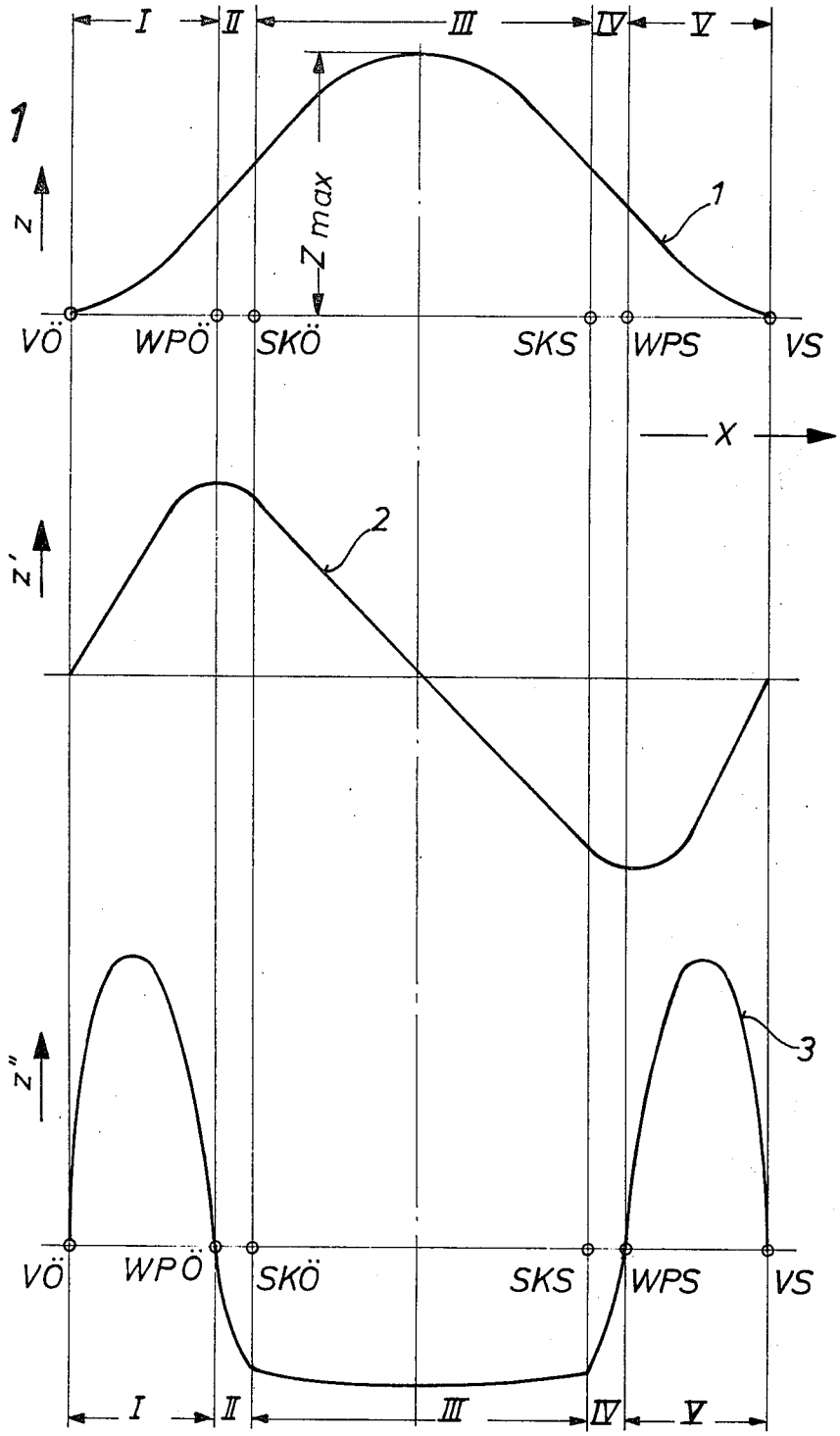
FIG. 1 illustrates by way of a graph the cam and push rod stroke, the cam velocity and the cam acceleration in conformity with or dependent on the cam angle.

The cam according to the present invention is characterized primarily in that the design of the cam contour, in addition to taking into consideration good dynamic conditions also takes into consideration the lubricating behavior especially within the retardation region. The prerequisites for this are:

1. High values for the lubrication number at the cam nose.
2. A rapid passing through the zero passage, in other words the highest possible rise in the lubrication number function in the transition region between the cam nose and the flanks.

To this end, according to the present invention, the acceleration and deceleration or retardation region is divided into a total of five regions or sections designated I–V and a. the acceleration regions I and V of the opening and closing flanks are defined by a Fourier-series of the third order by the following statement:

$$z_j'' = a_{j_1} \cdot \sin\alpha + a_{j_2} \cdot \sin 2\alpha + a_{j_3} \cdot \sin 3\alpha$$

In this formula $j$ designates the respective section or phase I or V. The values $a_j$ to $a_j$ are selectable depending on the specified conditions, and $\alpha$ indicates a function of the cam angle $x$.

b. the phase or section II following the opening flank and the retardation phase or section IV ahead of the closing flank bring about a precisely constant rise in the lubrication number curve (FIG. 2) while for the cam stroke $z$ the following relationships apply:

Phase or Section II $$z_{II} = a_4 \cdot \sin\left[\sqrt{0.5}\,(x - WP\ddot{O})\right] - SK(x - WP\ddot{O}) + z_{AII}$$

Phase or Section IV $$z_{IV} = a_7 \cdot \sin\left[\sqrt{0.5}(x - SKS)\right] + a_8 \cdot \cos\left[\sqrt{0.5}\,(x - SKS)\right] + SK(x - SKS) + z_{A\,IV}$$

The values $a$ and $z_A$ result from the continuity of the stroke curve $z$ and the first and second derivations thereof $z'$, $z''$ according to the cam angle $x$, $WP\ddot{O}$ designates the reversal point or the point of reversal with the cam lift on the opening side, whereas $SK$ designates the start of the constant decrease in the lubrication number on the closing side.

c. In the section III within the region of the highest retardation or deceleration, a constant lubrication number $s$ is obtained which is determined by the relays to the cam lift $z$ by the formula $$z_{III} = a_5 \cdot \sin\left[\sqrt{0.5}(x - SK\ddot{O})\right] + a_6 \cdot \cos\left[\sqrt{0.5}(x - SK\ddot{O})\right] + Smax + RG$$

In this formula SKÖ designates the end of the constant lubrication number, Smax designates the maximum lubrication number value, and RG indicates the radius of the base circle of the cam.

Thus, a cam shape is suggested which takes into full consideration the various points referred to above in connection with the problem underlying the present invention. The lifting curve of said cam shape need, however not be symmetric in all circumstances, particularly inasmuch as experience has shown that with regard to the dynamics it is frequently desirable to design the opening and closing sides so that they differ from each other.

Figure 2:
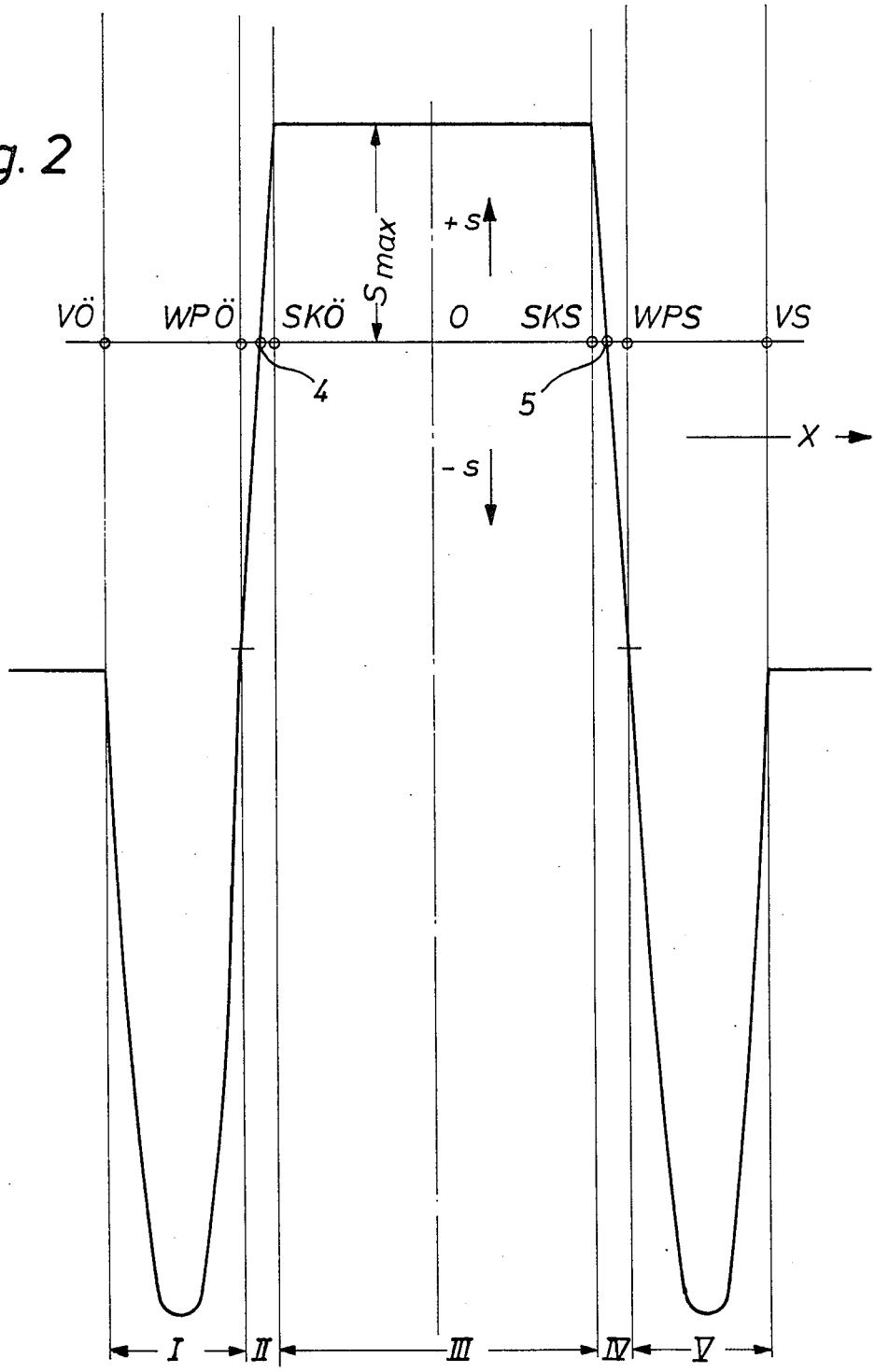
FIG. 2 illustrates by way of a graph the course of the lubrication number.

Referring now to the drawings in detail, the curve designated with the reference numeral 1 shows the cam and push rod stroke $z$ while the curve 2 shows the cam velocity $z'$, and while the curve 3 shows the cam acceleration $z''$, each depending on the cam angle $x$. FIG. 2 shows the course of the lubrication number $s$. From the valve opening point VÖ up to the valve closing point VS, the cam contour according to the invention is divided into five sections I–V.

Section I which represents the region of the opening flank extends from the valve point VÖ up to the reversal point WPÖ of the opening side. The section V representing the region of the closing flank starts at the reversal point WPS of the closing side and ends at the valve closing point VS. Both section are characterized by the acceleration $z''$ (curve 3 in FIG. 1), in other words by the second derivation of the cam stroke $z$ (curve 1 of FIG. 1) in conformity with the cam angle. The cam acceleration $z''$ is, as mentioned above, described by a Fourier-series of the third power in a sinusoidal:

$$z_j'' = a_{j_1} \cdot \sin\alpha + a_{j_2} \cdot \sin 2\alpha + a_{j_3} \cdot \sin 3\alpha$$

instead of $j$, the respective section I or IV is to be applied. Inasmuch as the opening and closing shock considerably affect the dynamic behavior, it is possible by an appropriate selection of the values $a_{j_1}$, $a_{j_2}$, and $a_{j_3}$ to determine the course of acceleration in conformity with the elasticity of the valve structure or valve train. The angle $\alpha$ represents a function of the cam angle x and can be calculated for the section I and V with the aid of the drawing by the following formula:

$$\alpha_I = \left(\frac{x - V\ddot{O}}{WP\ddot{O} - V\ddot{O}}\right) \cdot 180^\circ \qquad \alpha_V = \left(\frac{x - WPS}{VS\ WPS}\right) \cdot 180^\circ$$

In this formula, $\alpha$ may be greater, equal to or less than 180° which means $\alpha$ may range from 0 to 180°.

The sections II, III and IV represent the deceleration or retardation region of the cam contour which, as mentioned above, is decisive for the formation of a hydrodynamic lubricating film between the cam and the push rod. In the retardation region, the following lubrication functions are to be attained:

The zero passage of the lubrication number $s$ (points 4 and 5 in FIG. 2) takes place in the sections II and IV. Therefore, it is suggested that within these sections or phases the increase in the lubrication number function $s'=ds/dx$, in other words their first derivation with regard to the cam angle $x$, should be kept precisely constant while the ascent value SK may be preset. Both sections or phases are characterized by the cam lift $z$. Phase or section II extends from the point of reversal WPÖ of the opening side up to the point SKÖ, and section or phase IV starts at the point SKS and ends at the point of reversal WPS at the closing side. To the cam stroke $z$ the following relations apply:

Section or Phase II:

$$z_{II} = a_4 \cdot \sin[\sqrt{0.5}\ (x-WP\ddot{O})] - SK \cdot (x-WP\ddot{O}) + z_{AII}$$

Section or Phase IV:

$$z_{IV} = a_7 \cdot \sin[\sqrt{0.5}(x-SKS)] + a_8 \cdot \cos[\sqrt{0.5}(x-SKS)] + SK(x-SKS) + z_{A\ IV}$$

The parameters $a_4$, $a_7$, $a_8$, $z_{AII}$ and $z_{AIV}$ as well as the pertaining cosine in the section or phase IV are determined from the condition of the continuity of the curve 1 of stroke $z$ and from the first and second derivation $z'$, (curve 2) and $z''$ (curve 3) according to the cam angle $x$.

In the phase or section III representing the region of the cam nose, the lubricating number function is to remain constant while the maximum lubrication number value Smax may likewise be preset. This section starts at the point SKÖ which is reached when the lubrication number function at the end of the section II attains the value Smax, and ends in the point SKS which is calculated from the limit conditions of the cam lift. The section III is similarly to the section II and IV characterized by the cam lift $z$ according to the following formula:

$$z_{III} = a_5 \sin[\sqrt{0.5} \cdot (x-SK\ddot{O})] + a_6 - \cos[\sqrt{0.5}(x-SK\ddot{O})] + Smax + RG$$

The letter $x$ designates the angle of the traveling cam, and $RG$ stands for the radius of the base circle of the cam. The values $a_5$ and $a_6$ are calculated again from the condition of the continuity of $z$, $z'$ and $z''$.

It is, of course, to be understood, that the present invention is by no means, limited to the specific showing in the drawings but also comprises any modifications within the scope of the appended claims.

What we claim is:

1. For use in connection with a valve, with spring means continuously urging said valve into its closing position, and with a tappet having a flat bottom for opening said valve against the thrust of said spring means, a rotatable cam operable to be accelerated and decelerated, in which the acceleration and deceleration phases are divided into a total of five phase I to V, and in which the acceleration phases I and V of the opening and closing flank are determined by a Fourier series of third order by the following equation:

$$z_{jII} = a_{j1} \cdot \sin\alpha + a_{j2} \cdot \sin 2\alpha + a_{j3} \cdot \sin 3\alpha$$

where $j$ indicates the relevant phase I or V, the values $a_{j1}$ to $a_{j3}$ are selected according to the specified conditions, and $\alpha$ represents a function of the cam angle $x$, and in which phase II following the opening flank is characterized by the equation:

$$z_{II} = a_4 \cdot \sin[\sqrt{0.5}(x-WP\ddot{O})] - SK(x-WP\ddot{O}) + z_{A\ II}$$

and together with the phase IV of the deceleration phase before the closing flank bring about an axially constant increase in the lubrication number curve, said phase IV being characterized by the equation:

$$z_{IV} = a_7 \cdot \sin[\sqrt{0.5}(x-SKS)] + a_8 \cdot \cos[\sqrt{0.5}(x-SKS)] + SK(x-SKS) + z_{A\ IV}$$

The values $a$ and $z_A$ resulting from the continuity of the lift curve $z$ and the first and second derivation $z'$,$z''$ with respect to the cam angle $x$, $WP\ddot{O}$ being the reversal point at the cam lift on the opening side, $SK$ representing the ascent value and $SKS$ the start of the constant drop in the lubrication number at the closing side, and in which in phase III in the range of highest deceleration a constant lubrication number is attained which is determined by the correlation to the cam lift $$z_{III} = a_5 \cdot \sin[\sqrt{0.5}(x-SK\ddot{O})] + a_6 \cdot \cos[\sqrt{0.5}(x-SK\ddot{O})] + Smax + RG,$$

$SKO$ being the end of the constant cam rise, $Smax$ representing the maximum lubrication number value, and $RG$ representing the cam base circle radius.

* * * * *